United States Patent [19]

Racine

[11] Patent Number: 4,512,554

[45] Date of Patent: Apr. 23, 1985

[54] LEVERING TOOL FOR MANHOLE COVER

[75] Inventor: Jacques Racine, Charlesbourg, Canada

[73] Assignee: Hydro-Quebec, Quebec, Canada

[21] Appl. No.: 476,816

[22] Filed: Mar. 18, 1983

[30] Foreign Application Priority Data

Dec. 21, 1982 [CA] Canada ..... 418234

[51] Int. Cl.[3] ..... B66F 3/00

[52] U.S. Cl. ..... 254/131

[58] Field of Search ..... 254/DIG. 1, 88, 131, 254/132, 120, 16–17, 209, 243, 251, 256, 261; 248/156, 346

[56] References Cited

U.S. PATENT DOCUMENTS

| | | | |
|---|---|---|---|
| 853,840 | 5/1907 | Taylor | 254/132 |
| 1,109,089 | 9/1914 | Tucker | 254/88 |
| 1,220,347 | 3/1917 | Lampert | 254/243 |
| 1,269,952 | 6/1918 | Mountain | 254/131 |
| 1,317,145 | 9/1919 | Skantz | 254/120 |
| 2,846,259 | 8/1958 | Sadler | 254/131 |
| 3,883,117 | 5/1975 | Powell | 254/131 |
| 4,055,330 | 10/1977 | Chapman | 254/131 |
| 4,108,421 | 8/1978 | Extine | 254/88 |
| 4,218,043 | 8/1980 | Le Vert | 254/DIG. 1 |
| 4,280,683 | 7/1981 | Knierim | 254/17 |
| 4,338,053 | 7/1982 | Abel | 248/346 |

FOREIGN PATENT DOCUMENTS

| | | | |
|---|---|---|---|
| 616749 | 4/1933 | Fed. Rep. of Germany | 254/131 |
| 20051 | 6/1930 | Norway | 254/131 |

*Primary Examiner*—Robert C. Watson

*Attorney, Agent, or Firm*—Oblon, Fisher, Spivak, McClelland & Maier

[57] ABSTRACT

The invention relates to a levering tool useful to lift up a manhole cover from its housing and to drag it away from the manhole inlet. The tool comprises a base provided with anti-skidding elements formed of studs and a series of parallel plates, and a rigid and elongated power bar. This power bar has one extremity mounted for pivotal displacement onto the base so that the free extremity is moved along an arc in a predetermined direction. A link of appropriate resistance is set between the power bar and the cover, and fasteners firmly connect the latter to the bar through the link. The tool works to displace the cover by applying a small force on the free end of the power bar while maintaining the anti-skid base substantially stable, therefore maintaining safe operation by the user.

11 Claims, 7 Drawing Figures

LEVERING TOOL FOR MANHOLE COVER

BACKGROUND OF INVENTION (a) Field of Invention

The present invention relates to hand tools for displacing relatively heavy objects and concerns more particularly an improved levering tool generally useful in displacing such objects in a safe and easy manner. More specifically, that new tool is to be used to lift and displace manhole covers or lids from their housing and also to drag them along a distance to clear the manhole. The same tool also serves to drag the cover back over the manhole to its initial position.

(b) Description of Prior Art

The operation of lifting a cover for clearing a manhole inlet may appear a rather simple and a common place operation. It is to be noted, however, that most of those manhole covers are made of cast iron the appropriate weight of which ranges from 140 kilograms to 180 kilograms and that the clearance between the cover edge and the inner rim of the manhole cover support and housing is substantially low so that appropriate tools are required by workers to handle those awkward pieces. To do so, simple hooks are usually used by workers where the hooks are inserted into holes provided into the cover. That method asks for considerable effort from the worker who, at the start, has to lean forward with his feet apart from one another and close to the manhole outer edge to pull the cover from its housing. This strains the arm, shoulder and back muscles. Moreover, additional efforts have to be supplied by the worker since most frequently rust or ice (usual in northern areas) could be formed between the cover and the manhole support surface. Those characteristics result in a number of injuries which are often encountered by the worker, such as sore back, muscular strains, directly related to the efforts supplied, or from injuries resulting from the slippage of the manhole on a foot where the work is performed on loose soil or slippery surfaces.

To minimize those hazards as well as the effort necessary to lift up manhole covers, some levering tools were proposed. One solution comprises a lever having two rods linked together, one rod being positioned vertically and resting against the cover at a point slightly inside the peripheral edge thereof, whereas the other rod is hooked into a hole provided in the cover at a point opposite to the vertical rod fulcrum. Thus, by applying a force upon the vertical rod, it is possible to raise the cover and rock it outside its housing. However, the worker still has to supply considerable effort to perform the operation and the method is rather unsafe since at the start he must lean forward whereas he has to tilt backward when the cover is rocked, thereby increasing the slippage hazard. Moreover, a lateral effort has to be provided to pull the cover aside and away from the manhole inlet while maintaining same lifted. For those reasons, that device has not proven satisfactory.

Another type of lever was also proposed for the same purpose. The latter is made up of a slightly upwardly bent rigid rod one extremity of which is so shaped as to be inserted into a hole provided into a cover. At a given distance from the inserted extremity, there is set a bearing wheel acting as the fulcrum so that an action onto the free end of the rod allows to lift the cover which may be dragged away from the inlet by pulling the rod, which therefore requires a double effort and action from the worker. Moreover, when the cover is lifted, the above setting becomes out of balance since a light lateral movement from the worker causes the wheel to tip over. Additionally, that type of lever cannot be used where the surface immediately adjacent the manhole is covered with snow, grass, loose soil or when the surrounding ground surface is at a lower level than the cover surface.

SUMMARY OF INVENTION

A feature of the present invention resides in a levering tool which overcomes the above-mentioned drawbacks of the prior art.

Another feature of the present invention is to provide a levering tool which is not only efficient and easy to handle but also completely safe to workers whatever the nature and condition of the surface surrounding the object to be displaced.

A further feature of the present invention is to provide a levering tool which requires relatively small effort from the user to operate, either for lifting a manhole cover from its housing or for displacing it along an horizontal plane.

A preferred feature of the present invention resides in that the anti-skidding elements of the base comprise studs to avoid skidding of the levering tool when the latter is positioned onto a concrete, asphalt or icy surface.

Another feature of the present invention comprises the use of thin metal plates being substantially equi-distant from one another and disposed so as to withstand any forward movement of the base when the levering tool is operated onto loose soil, grass or snow. Also, this type of base construction prevents it from digging holes into the soil, grass or snow.

A further preferred feature of the present invention is that the power bar consists of a solid or hollow tube or rectangular cross-section and onto which are mounted one or more fasteners to link up firmly the object to be displaced.

According to the above features, from a broad aspect, the present invention provides a levering tool useful in displacing an object, such as a manhole cover, out of or onto its housing at substantially ground level and permitting the object to be dragged over a distance sufficiently long whereby the object can be pulled over obstacles in the environment of the housing. The tool comprises a base provided with anti-skidding elements in a lower surface thereof and a foot receiving upper surface onto which the user can stand to provide a restraining load on the base. An elongated and rigid power bar is provided and has a lower end mounted for pivotal movement on the base and an upper end which is free for movement along an arc in a predetermined direction. The upper end defines a hand gripping end so that a person can effect the pivotal movement by pulling the power bar from the said upper end. A link of appropriate resistance is connectible between the power bar and the object. The link is connectible to the bar intermediate the upper end and the lower end thereof. Connecting means firmly connects the object to be displaced to the power bar through the link whereby a hand pulling force applied on the upper end of the power bar causes outward displacement of the object out of the housing by straining the link with the anti-skid base remaining substantially stationary whether on hard or soft surfaces such as concrete, asphalt, loose soil, grass, ice or snow.

BRIEF DESCRIPTION OF DRAWINGS

A preferred embodiment of the present invention will be hereinafter described with reference to an example thereof illustrated by the accompanying drawings wherein:

Referring to FIG. 1, there is generally shown the various components forming the levering tool 1 when operated by a worker 2 to lift up a manhole cover 9 from its housing. As illustrated, the levering tool 1 is a lever constituted by a power bar 3 so mounted to pivot about a base 4 which rests on the ground close to a manhole inlet shut by a cover 9. The power bar 3 is made up of a rigid material having an elongated shape and is of a length sufficient to allow the user 2 to actuate the lever while remaining in an upright position. The pivot 7 linking the power bar 3 to the base 4 is so conceived to allow the power bar extremity 11 to pivot freely and easily when actuated rearwardly along an arc to tighten a link 12 one extremity of which is provided with a hook which is freely inserted into the hole 10 provided into the cover 9. The outer extremity of the link 12 is connected to a fastener 8 fixed onto bar 3 at a given distance from the pivot 7 acting as the fulcrum for the lever.

Figure 1:
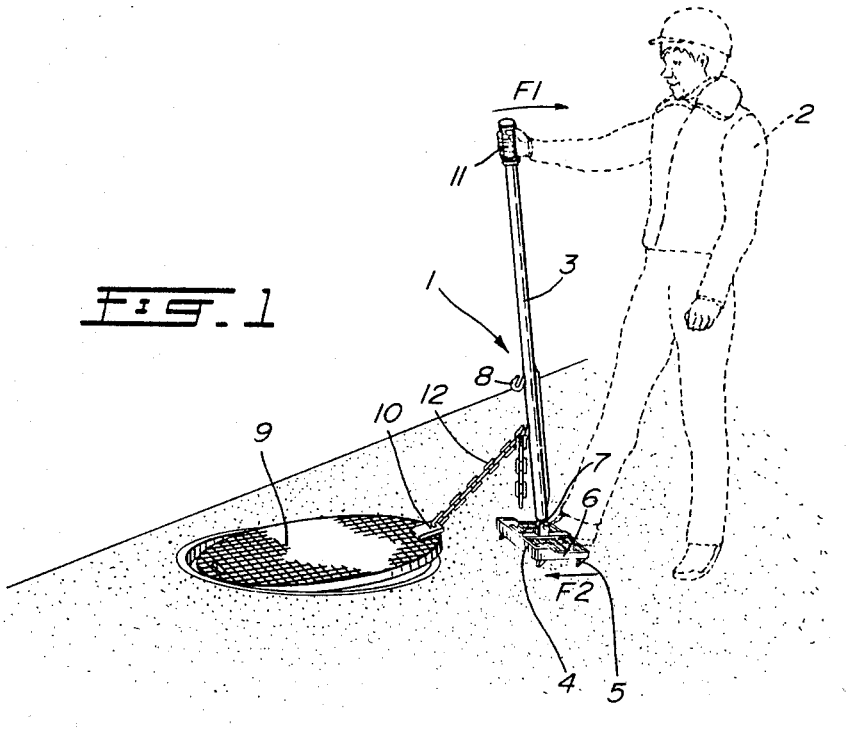
FIG. 1 illustrates a levering tool according to the present invention as used by a worker.

Concerning the base 4, it is provided with anti-skidding elements 5 and 6 which fixedly and firmly retain the base against the ground when a pulling force is applied at the free extremity 11 of the power bar in the direction indicated by arrow F1, which applied force produces a counter-force onto the base in a direction opposite to F1 and indicated by arrow F2. As the ground surface immediately surrounding the manhole is of various composition, two types of anti-skidding elements are provided on the base 4 to suit all kinds of ground surfaces usually encountered. Thus, a pair of metal studs 5 formed of anti-abrasive steel are fixedly mounted on each of the lateral sides of the base 4. The metal studs 5 project out from the lower edge of the base 4 and have the tip thereof directed towards the direction of application of force F2 so as to oppose any forward movement of that base 4. Furthermore, a series of metal plates 6 are mounted in parallel and substantially equi-distant from one another and extend transversely to the direction of application of force F2. Studs 5 are particularly efficient to maintain the base 4 stable on hard surfaces such as those made up of concrete, asphalt or ice, whereas the parallel plates 6 prove effective when the base is resting on a soft or light soil such as earth, grass, sand or snow. It is also to be noted that the stability of the base 4 is substantially increased due to the fact that the worker has one of his feet firmly resting onto the base during the operation rendering the tool very safe.

Figure 2:
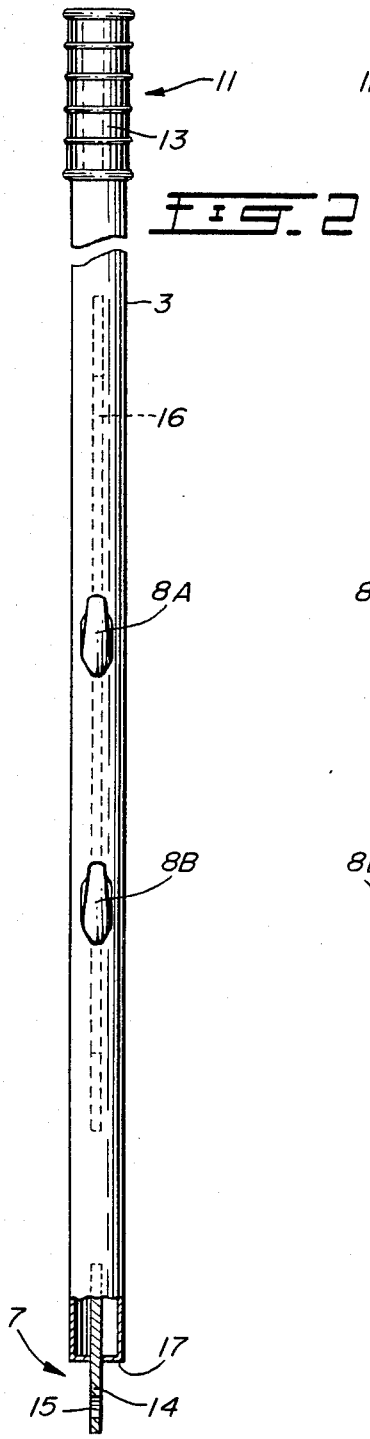
FIG. 2 is a front view of the power bar of the levering tool.
Figure 3:
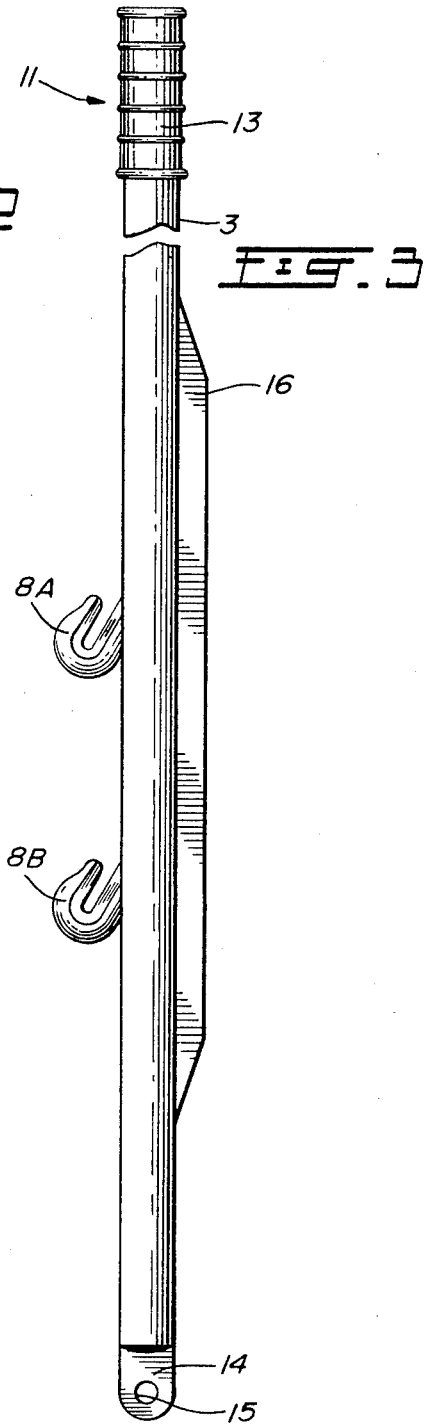
FIG. 3 is a side view of the power bar.

According to the example of the embodiment illustrated in FIGS. 2 and 3, the power bar 3 is mainly formed of a tubular body provided with a rubber sleeve handle 13 at the free end 11 thereof for a better grip on the power bar 3 whereas the pivoted lower end 7 comprises a metal plug 17 fixedly mounted at the extremity of the tube. An adaptor 14 provided with an opening 15 is fixed to the metal plug 17, the adaptor 14 being set perpendicularly to the plug 17 and along the longitudinal axis of the power bar 3. In the present case, two hooks **8*a* and 8*b* are firmly attached onto the outer surface of the power bar 3 and at different distances. For instance, where the ground surface surrounding the manhole cover is at a lower level than that of the cover, hook 8*a* will then be used for obvious reasons, to which will be tied the link connecting the power bar 3 to the cover. However, in general, the link should be usually anchored to hook 8*b* rather than 8*a* since the operation of the present levering tool is essentially based upon the lever principle and it is obvious that the closer the resistance force is to the fulcrum 7, the less will be the force necessary to be applied at the free end 11 of the power bar to effect displacement of the cover. It is to be noted that in the instant example, hook 8*a* is set at about $\frac{1}{3}$ of the total length of the power bar 3 whereas hook 8*b* is located at approximately $\frac{1}{4}$ of that length. A reinforcing member 16 is secured along the wall of the power bar 3, at a location opposite to the securement location of hooks 8*a* and 8*b*. It is noted that hooks 8*a* and 8*b* as well as the reinforcing member 16 are located in the same plane as the adaptor 14**.

Figure 4:
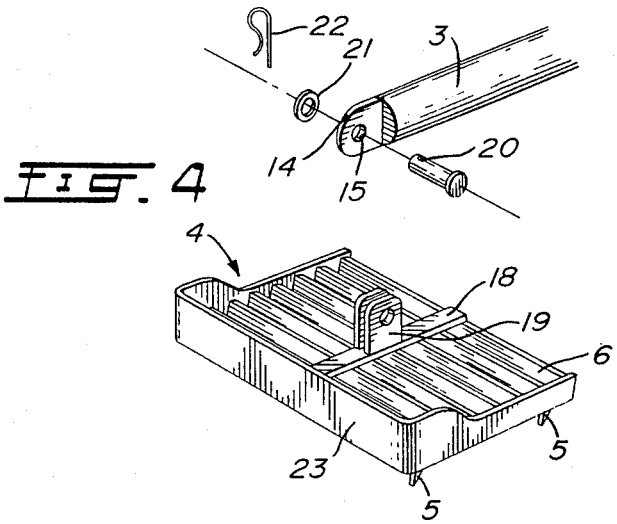
FIG. 4 shows the base of the levering tool as well as the means for mounting the power bar thereonto.

FIG. 4 shows an isometric view of the base 4 and the elements connecting the power bar 3 to the base 4. The adaptor 14 of bar 3 is inserted between the metal plates of a fork-joint 19 provided with holes bored in registry and of a size similar to that of hole 15 in adaptor 14. The fork-joint 19 is firmly secured to a support 18 which is connected to the upper part of the metal plates 6 and disposed transversely to these plates and perpendicularly to the front side of the base 4. A bolt 20, a ring 21 and a safety pin 22 firmly retain the adaptor 14 connected to the power bar 3 to the fork-joint 19 while allowing pivotal movement of the power bar about its pivot connection. This connection also permits the disassembly of the power bar to facilitate storage thereof.

Figure 6:
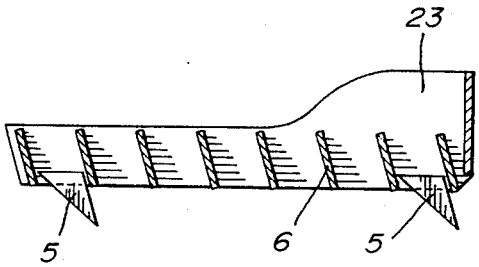
FIG. 6 is a cross-sectional view of the base taken along line A—A of FIG. 5.
Figure 7:
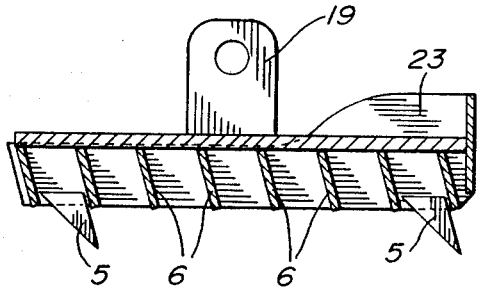
FIG. 7 is a cross-sectional view of the base taken along line B—B of FIG. 5.
Figure 5:
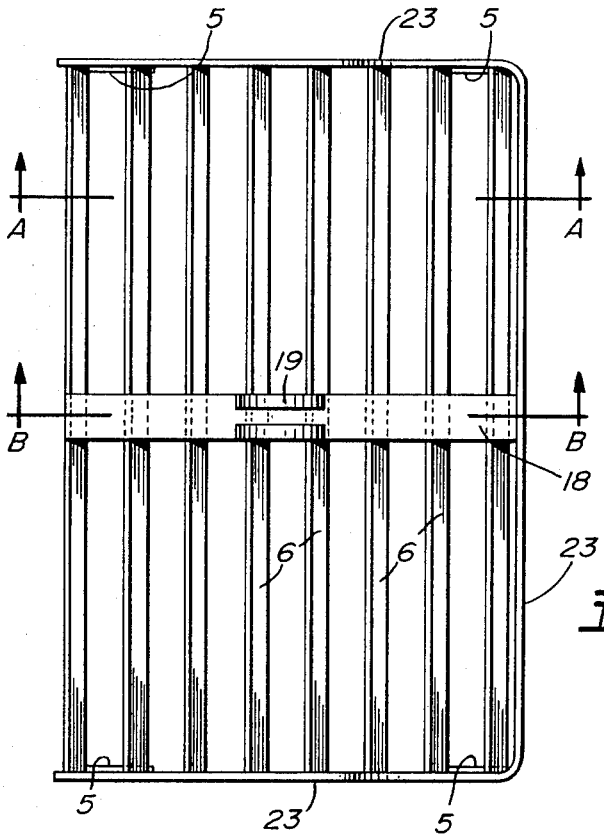
FIG. 5 is a front view of the base.

As illustrated in FIGS. 5, 6 and 7, base 4 is of a rather simple construction but highly efficient in carrying out the function assigned within the levering tool arrangement of the present embodiment. In order to allow that tool to operate actually in accordance with the known lever characteristics, it is necessary that the lever fulcrum be exceptionally stable whatever the nature of the grund surface onto which the tool is resting. That is achieved through the engagement of four studs 5, secured in pairs to the inner surface of the lateral sides of the single U-shaped plate 23. This plate 23 extends along the lateral side as well as the front side of the base 4. It is noted that the studs 5 are slightly forwardly inclined by an angle of about 15° in order to counteract efficiently against the force applied at the fulcrum point of the pivot joint 7 when the levering tool is operated. It is also noted that in the present design eight plates 6 are secured in parallel to one another and also in parallel to the front side of the base 4 and these plates are disposed equi-distantly from one another. The extremities of each plate 6 are firmly secured to the lateral side of the U-shaped plate 23. Each plate 6 is so mounted as to form an angle of about 15° with the vertical plane, in a manner similar to the studs 5, in order to resist efficiently to any forward movement of the base when the levering tool rests on snow, earth, grass or sand. Furthermore, the U-shaped plate 23 which is made of metal has a front end, the upper edge of which is slightly higher than that of the lateral sides, so as to allow the ground to rest more freely against the anti-skidding plates 6. Also, this elevated upper edge protects the foot of the user against injury that may be caused when lifting the cover.

It is understood that the present invention incorporates any obvious modifications of the levering tool described above by way of example. It would be obvious to modify the power bar 3, which is made tubular in the present case, into a solid or hollow power bar having a rectangular cross-section. Similarly, the hooks 8*a* and 8*b* may be replaced by a single hook or other such attachment means capable of being displaced along the power bar wall and provided with stop notches so as to set the movable hook at any height or distance along the power bar. Concerning the link connecting the hooks of the power bar to the object to be displaced, that link may comprise any high stress resistance cable or chain. As to the means joining the link to the cover, any adequate type of hooks may be used together or not with shackles. Therefore, the gist of the levering tool described above is only limited by the scope of the appended claims.

I claim:

1. A levering tool useful in displacing an object, such as a manhole cover, out of or onto its housing at substantially ground level and permitting said object to be dragged over a distance sufficiently long whereby the object can be pulled over obstacles in the environment of the housing comprising:

a base provided with anti-skidding elements in a lower surface thereof and a foot receiving upper surface onto which the user can stand to provide a restraining load on said base; said anti-skidding elements being a series of plates of a substantially similar dimension and disposed parallel to one another and secured to said base, each plate of said series of plates lying at an angle of about 15° from a vertical axis;

an elongated and rigid power bar having a lower end mounted for pivotal movement on said base and an upper end of said power bar being free for movement along an arc in a predetermined direction, said upper end defining a hand gripping end so that a person can effect said pivotal movement by pulling said power bar from said upper end;

a link of appropriate resistance connectable between said power bar and said object;

connecting means firmly connecting said object to be displaced to said power bar through said link whereby a hand pulling force applied on said upper end of the power bar causes outward displacement of said object out of the housing by straining said link with said anti-skid base remaining substantially stationary whether on hard or soft surfaces such as concrete, asphalt, loose soil, grass, ice or snow.

2. A tool as claimed in claim 1, wherein said base is of a rectangular shape and comprises a one-piece U-shaped plate.

3. A tool as claimed in claim 2 wherein a series of plates of a substantially similar dimension and disposed parallel to one another and secured to said base, each extremity of said series of plates are secured to each parallel side of said U-shaped plate.

4. A tool as claimed in claim 2, wherein said anti-skidding elements of the base comprise studs fixed to the parallel sides of the U-shaped plate, each stud projecting out from the lower edge of the U-shaped plate.

5. A tool as claimed in claim 3, wherein the pivoting lower end of said power bar is inserted into a fork-joint connected to said base in a plane substantially perpendicular to said series of plates.

6. A tool as claimed in claim 1, wherein said power bar has a circular cross-section and said connecting means comprise at least one hook secured at a predetermined distance along said bar and fixed to the outer wall thereof.

7. A tool as claimed in claim 6, wherein the pivoting lower end of said power bar comprises a plug mounted perpendicularly to the longitudinal axis of the elongated bar and an adaptor fixedly and perpendicularly held onto said plug, the adaptor being inserted in a fork-joint fastened to said anti-skid base.

8. A tool as claimed in claim 6, wherein a reinforcing element is secured along the wall of said power bar at a location opposite to said hook.

9. A tool as claimed in claim 4, wherein said studs extend at an angle of about 15° from a vertical axis.

10. A tool as claimed in claim 1, wherein said connecting means comprise a hook to be inserted in a hole provided in said cover and a shackle connecting said hook to said link.

11. A tool as claimed in claim 1, wherein said link is a metal chain.

* * * * *